United States Patent [19]

Kabbany

[11] Patent Number: 4,583,739

[45] Date of Patent: Apr. 22, 1986

[54] GOLFER'S STANCE POSITIONING DEVICE

[76] Inventor: Reda Kabbany, 1143 Thorn St., St. Paul, Minn. 55106

[21] Appl. No.: 463,820

[22] Filed: Oct. 19, 1983

[51] Int. Cl.[4] ..... A63B 69/36

[52] U.S. Cl. ..... 273/187 R

[58] Field of Search ..... 273/187 R, 187 A, 187 B, 273/195 R, 183 A

[56] References Cited

U.S. PATENT DOCUMENTS

| | | | |
|---|---|---|---|
| 2,169,407 | 8/1939 | Crowley | 273/187 R |
| 3,658,344 | 4/1972 | Kimble | 273/187 R |
| 4,257,608 | 3/1981 | Funk | 273/187 R |
| 4,354,683 | 10/1982 | Woolland | 273/187 R |

FOREIGN PATENT DOCUMENTS

| | | | |
|---|---|---|---|
| 1224980 | 2/1960 | France | 273/187 R |
| 16930 | 7/1911 | United Kingdom | 273/187 R |
| 17666 | 12/1915 | United Kingdom | 273/187 R |

*Primary Examiner*—George J. Marlo

*Attorney, Agent, or Firm*—Dorsey & Whitney

[57] ABSTRACT

A golf aid having a pair of elongated members pivotally secured to one another and pivotable between an operable position and a collapsed, inoperable position. The members include sets of indicia to define foot placement and ball placement for a particular club. A connector element enables one elongated member to be slidably adjusted therein while being pivotable relative to the other elongated member. An opening in the upper surface of the connector enables the golfer to view golf club identification indicia on one elongated member so that proper ball placement can be achieved for a particular club.

9 Claims, 7 Drawing Figures

Fig. 1
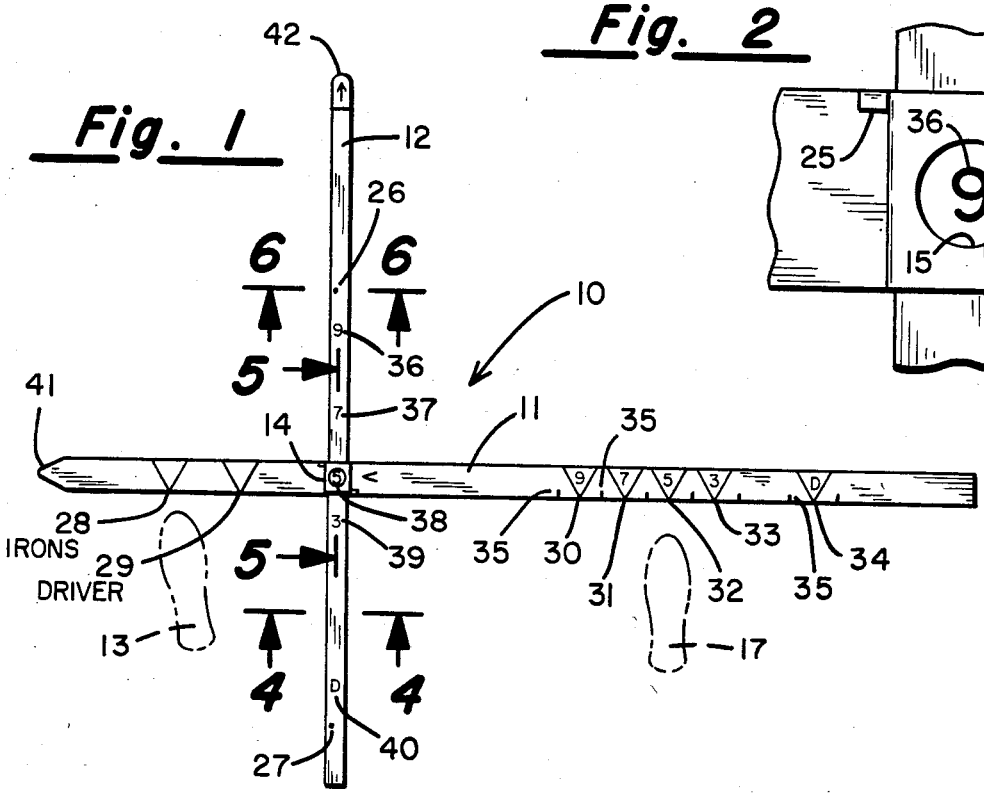
Fig. 2
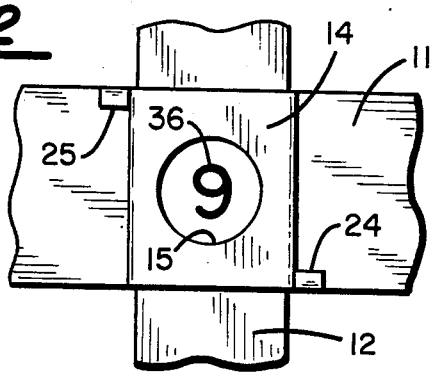
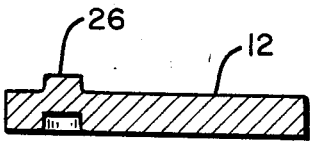
Fig. 6
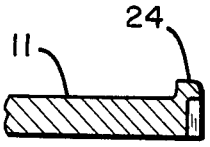
Fig. 7
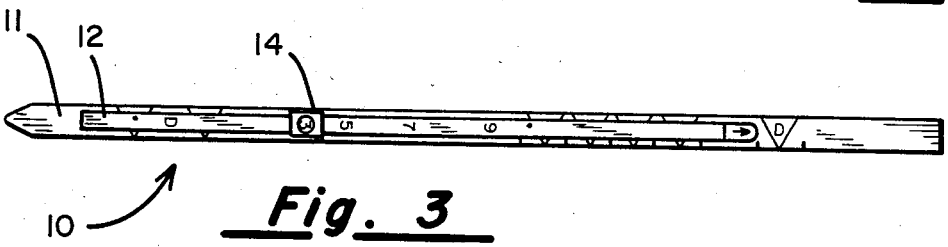
Fig. 3
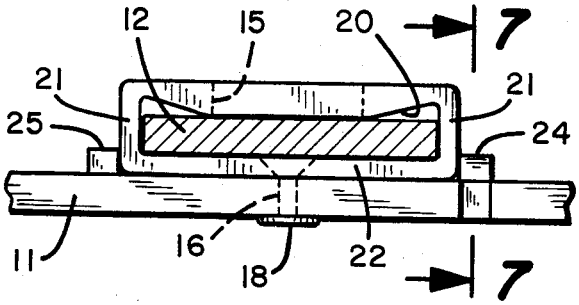
Fig. 4
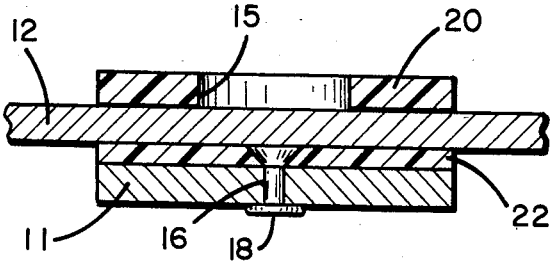
Fig. 5

GOLFER'S STANCE POSITIONING DEVICE

BACKGROUND OF THE INVENTION

The present invention relates generally to a golf aid, and more particularly, to a device for assisting in the improvement of the user's golf game.

Although there are many different stances which are used by golfers who play golf, there is a generally recognized right way and a wrong way to stand when hitting a golf shot. This is particularly true for someone who is just learning the game or for someone who wishes to improve upon his or her game by adopting a proper stance. In a correct stance, there is a relationship established between the lead foot (or left foot for a right handed golfer), the rear foot (or right foot for a right handed golfer) and the position at which the ball is teed or placed. Several devices are currently on the market which attempt to illustrate to the golfer where to place his feet and where to tee or place the ball when hitting shots with various clubs. One such device comprises a mat on which an outline of feet are disposed together with indications of where the ball is teed for various wood and iron shots. Although this device illustrates where the golfer should position his feet when hitting certain shots, it is an unsatisfactory device since it is not recommended by the manufacturer that a golf ball be hit while using the mat. Thus, it is generally a static type of device. Secondly, it is not easily transported and thus not readily usable while playing or practicing golf. Furthermore there are no provisions for golfers of different size or height. Another example of a product presently available is a device comprising a generally "T" shaped element with a plurality of holes along the horizontal leg of the device. A golf tee is passed through one of these holes to tee the ball. A second portion of the device is adapted longitudinally for movement with respect to the vertical leg of the device to properly space the feet. Similar to the afore-mentioned golf mat, it is difficult to hit a golf ball from this device since the club would undoubtedly hit the device itself, thus interfering with the mechanics of a proper golf swing. Secondly, it is not easily transported, carried or stored in the golf bag.

Accordingly, there is a need in the art for a golf aid which facilitates proper placement of the golfer's feet relative to the target while properly aligning the golfer's feet, hips, shoulder and club face relative to the ball and each club selection, but which does not interfere with the golfer's stance or the golfer's swing. There is also a need in the art for a golf aid device of this sort which is compact, economical, adjustable for different sizes of golfers and readily transportable so that it can be used on driving ranges and yards and even during play on the golf course if desired.

SUMMARY OF THE INVENTION

In contrast to the prior art, the golf aid of the present invention comprises a device which properly positions the golfer with respect to the target, insures proper alignment of the golfer's feet, shoulders, hands, hips and club face so that a correct stance is achieved and also insures proper position for placing the ball relative to the golfer's feet and club selection. Additionally, the device of the present invention is lightweight, simple and collapsible to a size which is readily carried in a golf bag. Further, the device of the present invention does not interfere with the golf swing. Thus it can be used on the practice range or yards, or even during the play of an actual round of golf to develop muscle memory.

One of the main problems that plagues golfers is inconsistency or the inability to repeat the safe stance for each club used to produce the proper swing. The golf aid when used at the driving range or in the yard will allow the golfer to take proper stance for any given club and swing the club freely and repeatedly with or without the presence of a ball to develop muscle memory for proper stance, so that in an actual game the golfer can reproduce the proper stance and swing based on the developed muscle memory.

More specifically, the golfing aid of the present invention includes a pair of elongated members which are pivotable about a fixed pivot with respect to each other between a first inoperable or collapsed position in which the two elongated members are generally colinear with one another and a second, operable position in which the elements are disposed at right angles with respect to each other. One of the elongated elements is also movable along its longitudinal axis with respect to the other to define the position at which the ball is to be placed. Each of the elongated members include indicia on their upper face to indicate proper positioning of the golfer's feet and the teeing or placing of the ball when certain clubs are being used. Means are also provided for limiting pivotal movement of the elongated members relative to one another and for limiting longitudinal movement of one of the members.

Accordingly, it is an object of the present invention to provide an improved golf aid which insures a proper golf stance and proper positioning of the golfer with respect to the ball for each of various iron and wood shots.

Another object of the present invention is to provide an improved golf aid which is lightweight, economical and collapsible to a form which can be readily carried in a golf bag.

Another object of the present invention is to provide an improved golf aid of the type described above which does not interfere with a golf swing; thus facilitating use of the device on the practice range or during an actual round of golf to develop muscle memory.

These and other objects of the present invention will become apparent with reference to the drawings, the description of the preferred embodiment and the appended claims.

DESCRIPTION OF THE DRAWINGS

FIG. 1 is an elevational top view of the golf aid of the present invention in its expanded or operable position.

FIG. 2 is an enlarged elevational top view of the portion of the golf aid of the present invention where the two elongated members intersect.

FIG. 3 is an elevational top view of the golf aid of the present invention in its collapsed, stored or inoperable position.

FIG. 4 is a view, partially in section, as viewed along the section line 4—4 of FIG. 1.

FIG. 5 is a view, partially in section, as viewed along the section line 5—5 of FIG. 1.

FIG. 6 is a view, partially in section, as viewed along the section line 6—6 of FIG. 1.

FIG. 7 is a view, partially in section, as viewed along the section line 7—7 of FIG. 4.

DESCRIPTION OF THE PREFERRED EMBODIMENT

With reference to FIGS. 1, 2 and 3, the golf aid of the present invention is indicated by the general reference numeral 10. As illustrated, the golf aid 10 includes a pair of elongated members 11 and 12 which are retained in operative relationship with one another by the slide and pivot member 14. The slide and pivot member 14, which retains the elongated member 12 in an operable position with respect to the elongated member 11 is pivotally secured to the member 11 about the pivot 16. The Pivot 16 is illustrated in solid lines in FIG. 5 and in broken lines in FIG. 4. As a result of the pivotally mounted slide 14, the member 12 is pivotally secured with respect to the member 11 between an expanded or operable position illustrated in FIG. 1 and a collapsed or inoperative position illustrated in FIG. 3.

In the preferred embodiment, the member 11 is elongated and includes a plurality of indicia and markings thereon. These markings are identified by the reference numerals 28–35. The markings 28 and 29 are positioned to the left of the pivot point between the elements 11 and 12 as viewed in FIG. 1 and are used to indicate correct placement of a golfer's left or lead foot when using the golf aid of the present invention. The markings 30–34 are positioned to the right of the intersection between the elements 11 and 12 as viewed in FIG. 1 and indicate placement of the right or trailing foot for a proper golf stance when using the device of the present invention. It should be noted that marking 28 indentifies placement of the left foot for all iron shots while marking 29 indicates proper placement of the left foot for driver and wood shots. The markings 30, 31, 32 and 33 identify the correct placement for the golfer's right foot when hitting a 9, 7, 5 and 3 iron, respectively. Marking 34 indicates the proper placement of the golfer's right foot when hitting a driver or other wood shot. A plurality of indicia or marks 35 are used to identify placement of the right foot for iron shots other then 9, 7, 5 and 3 irons and for placement of the right foot for woods other than the driver. These additional markings 35 can also be used by the golfer to alter the position of his right foot to better match the golfer's individual height. For example, a short golfer would place his or her foot on the mark 35 to the left of mark 30 when hitting a 9 iron whereas a taller golfer would place his or her right foot on the mark 35 to the right of the mark 30.

The member 12 is also elongated and includes a plurality of indicia or markings 36, 37, 38, 39 and 40. These markings 36–40 are intended to indicate the correct position of the member 12, and thus the ball, when hitting a particular club. As will be described in greater detail below, the member 12 is slidably retained by the pivotable slide 14 so that it can move in a generally longitudinal direction with respect to the element 11. The outer end 42 of the member 12 includes an arrow or other indicia for identifying the proper position for the golf ball. Movement of the member 12 along its longitudinal axis as shown in FIG. 1 causes the correct position of the placed ball to be identified by the outer end of the member 12. In the preferred embodiment, both the elements 11 and 12 are relatively flat, thin members and are constructed of a lightweight metal such as aluminum; however, it is contemplated that the device could be constructed from various other materials such as wood or plastic.

As illustrated best in FIGS. 2, 4 and 5, the slide and pivot member 14 comprises a short section of a hollow member. With reference to FIG. 4, the member 14 includes a top wall 20, a pair of side walls 21, 21 and a bottom wall 22. The top wall 20 includes an opening 15 to permit one of the markings 36–40 to be visually observed by the golfer using the device. The member 14 is pivotally secured to the member 11 in a fixed position about the pivot point 16. The pivot 16 can be a rivet, a threaded member or some similar means for pivotally securing the slide 14 to the member 11. In the preferred embodiment, the means 16 is a countersunk rivet having a flattened end 18 to retain it with respect to the member 11.

The interior dimensions of the hollow slide 14 are sufficient to permit the elongated member 12 to be slideably retained within the slide 14, in the manner illustrated. In the preferred embodiment, the top wall 20 of the slide 14 has a thickened portion which causes it to be slightly biased against the top surface of the element 12; thus causing the position of the member 12 relative to the member 11 to be retained unless manually altered.

The elongated member 12 also includes a pair of stop members 26 and 27 which function to prevent the member 12 from sliding completely out of the slide member 14. In the preferred embodiment, these stop members 26 and 27, as illustrated best in FIG. 6, comprise a portion which has been half punched from the member 12.

Although the slide member 14 can be constructed of a variety of materials, the preferred embodiment is constructed of a piece of durable plastic which is strong enough and tough enough to retain the member 12 with respect to the member 11.

Means are also provided for limiting the pivotal movement of the member 12 with respect to the member 11 so that it can be pivoted to its operative position illustrated in FIG. 1 in which the member 12 is at right angles with respect to the member 11. In the preferred embodiment, this means includes the stop members 24 and 25 which are raised portions of the member 11. These members 24 and 25 contact the sides of the slide member 14 to prevent further rotational movement when it reaches its operative position. FIG. 7 is a sectional view showing the construction of the stop member 24. As shown, it comprises a portion of the member 11 which has been half punched from the member 11.

Having described the description of the preferred embodiment of the present invention, the operation of the device can be understood as follows.

First, in its folded or collapsed position as illustrated in FIG. 3, the device 10 can be easily carried and kept in a golf bag. When it is desired to be used, it is taken from the bag and positioned on the ground so that the elongated member 11 is in alignment with and parallel to the anticipated flight of the ball to the target and the end 41 is in the direction of the target. The member 12 is then pivoted about the pivot point 16 to the position illustrated in FIG. 1 and the member 12 is then moved along its longitudinal axis through the slide member 14 so that the marking which identifies the club to be used is visually observed through the opening 15 in the slide 14. It should be noted that the member 12 can also be adjusted for the height of the golfer using the device. If the golfer is short, (i.e.) below 5′ 6″, the club number to be used is placed above the opening 15 in the member 14. For taller golfers, (i.e.) above 6′, the club number is placed below the window 15. The golf ball is then placed three inches from the end 42 of the member 12 and the golfer positions his feet with respect to the markings on the element 11. First he positions his left or lead foot with respect to the markings 28 and 29 and then positions his right or trailing foot with respect to the markings 30–35. Both feet should be parallel and two inches away from member 11. When this is done, the ball is ready to be hit. It should be noted that the device of the present invention permits the golfer to swing the club and hit the ball without interference from the device. When use of the device is completed, the member 12 is simply rotated about the pivot 16 to the inoperative or collapsed position as illustrated in FIG. 3 and returned to the golf bag. It should be noted that the device described and shown above is for a right handed golfer, but that a similar device could be constructed for a left handed golfer.

Although the description of the preferred embodiment has been quite specific, it is contemplated that various changes could be made without deviating from the spirit of the present invention. Accordingly, it is intended that the scope of the present invention be dictated by the appended claims rather than by the description of the preferred embodiment.

I claim:

1. A golf aid comprising:

a first elongated member comprising a single elongated element adapted for placement onto the golfing surface so that said first elongated member is generally parallel to the intended flight of the ball;

a second elongated member comprising a single elongated element adapted for placement onto the golfing surface so that said second elongated member is generally perpendicular to the intended flight of the ball;

slide and pivot means including an opening in its top surface and slidably connected with said second elongated member and pivotably secured to said first elongated member between its ends at a fixed point for facilitating the pivotal movement of said second elongated member relative to said first elongated member about said fixed point member between an operative position in which said first and second elongated members are disposed at right angles with respect to one another and a collapsed position in which said first and second elongated members are generally colinear, said slide and pivot means further facilitating the sliding movement of said second elongated member relative to said slide and pivot means and said first elongated member along the longitudinal axis of said second elongated member;

a first set of indicia on said first elongated member defining the proper position for the feet of the user of the golf aid for a particular golf club, said first set of indicia including left foot indicia located on one side of said fixed point and right foot indicia located on the other side of said fixed point, said left foot and right foot indicia including an identification of the various golf clubs and indicating the proper position for such left and right feet, respectively, for a particular golf club; and a second set of indicia on said second elongated member defining the proper position for placing the golf ball for a particular golf club, said second set of indicia including an identification of the various golf clubs and being viewable through the opening in the said slide and pivot means to provide means for aligning said second elongated member relative said first elongated member so that proper ball placement can be achieved for a particular club.

2. The golf aid of claim 1 including limit means for limiting the pivotal movement of said first and second elongated members to a position in which said elongated members are at right angles with respect to one another.

3. The golf aid of claim 2 wherein said limit means includes a raised portion on a surface of said first elongated member for engaging said slide and pivot member.

4. The golf aid of claim 1 wherein said slide and pivot member is a short tubular section surrounding said second elongated member.

5. The golf aid of claim 4 wherein said opening in said slide and pivot member permits selective visual observation of said second set of indicia on said second elongated member.

6. The golf aid of claim 5 wherein said slide and pivot means has internal dimensions providing a slight resistance to the movement of said second elongated member along its longitudinal axis.

7. The golf aid of claim 5 wherein said second set of indicia is disposed so that it is selectively visually observable through said opening in said slide and pivot member.

8. The golf aid of claim 4 including stop means for limiting the movement of said second elongated member relative to said slide and pivot means along its longitudinal axis.

9. The golf aid of claim 7 wherein said stop means includes a pair of raised portions on said second elongated member.

* * * * *